US010211011B1

(12) United States Patent
Chen

(10) Patent No.: US 10,211,011 B1
(45) Date of Patent: Feb. 19, 2019

(54) SWITCH FOR CONTROLLING ROTATIONAL DIRECTION

(71) Applicants: Wenzhou Shengpa Electronic Technology Co., Ltd., Yuequing, Zhejiang (CN); Kaietech Electronics Co., Ltd., Zhongshan, GD (CN)

(72) Inventor: Jian-Dao Chen, Yueqing (CN)

(73) Assignees: WENZHOU SHENGPA ELECTRONIC TECHNOLOGY CO., LTD., Yueqing, Zhejiang (CN); KAIETECH ELECTRONICS CO., LTD., Zhongshan, GD (CN)

( * ) Notice: Subject to any disclaimer, the term of this patent is extended or adjusted under 35 U.S.C. 154(b) by 0 days.

(21) Appl. No.: 15/883,632

(22) Filed: Jan. 30, 2018

(51) Int. Cl.

| | |
|---|---|
| ***H01H 15/04*** | (2006.01) |
| ***H01H 1/26*** | (2006.01) |
| ***H01H 15/10*** | (2006.01) |
| ***H01H 9/02*** | (2006.01) |
| ***H01H 1/58*** | (2006.01) |

(52) U.S. Cl.
CPC ..... *H01H 15/04* (2013.01); *H01H 1/26* (2013.01); *H01H 1/5866* (2013.01); *H01H 9/02* (2013.01); *H01H 15/10* (2013.01)

(58) Field of Classification Search
CPC ..... H01H 15/04; H01H 1/5866; H01H 9/02; H01H 1/26; H01H 15/10
USPC ..... 200/241–243, 252, 253, 536, 547, 549, 200/550
See application file for complete search history.

(56) References Cited

U.S. PATENT DOCUMENTS 3,674,953 A * 7/1972 Brevick ..... H01H 15/18 200/16 D
4,506,119 A * 3/1985 Tanabe ..... H01H 15/18 200/16 C

* cited by examiner

*Primary Examiner* — Edwin A. Leon
*Assistant Examiner* — Lheiren Mae A Caroc
(74) *Attorney, Agent, or Firm* — The Mueller Law Office, P.C.

(57) ABSTRACT

A switch includes a first conducting member mounted to a side of a plate and electrically connected between one pin and a first contact member, a second conducting member mounted to an opposite side of the plate and electrically connected between another pin and a second contact member, and a switch member movable on the plate to contact the pins or the first and second contact members at a time.

9 Claims, 9 Drawing Sheets

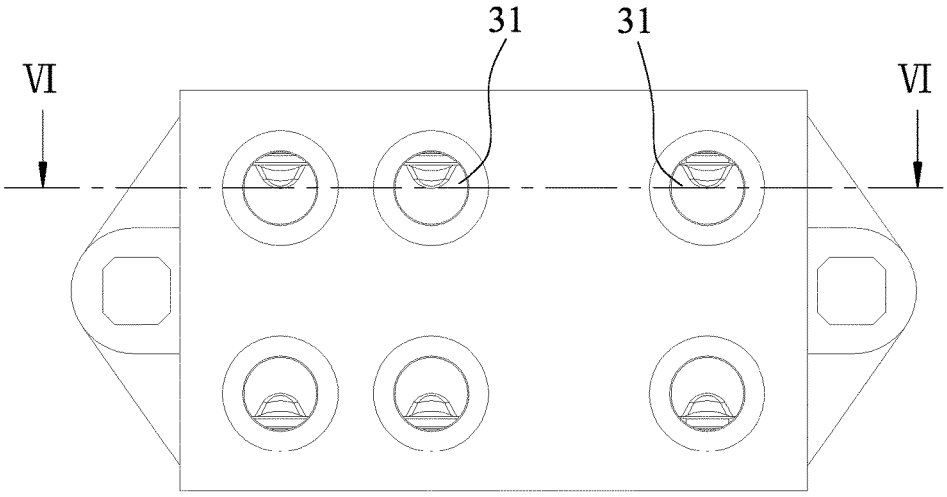
FIG.5
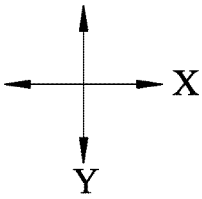

SWITCH FOR CONTROLLING ROTATIONAL DIRECTION

FIELD

The disclosure relates to a switch, and more particularly to a switch that can control rotational direction.

BACKGROUND

A conventional switch disclosed in Taiwanese Patent No. 204029 includes a top cap, a switch seat, six conducting plates, a lower extending plate, an insulating member, an upper extending plate, and a switch member mounted between the top cap and the switch seat, and movable between a first position and a second position. The switch seat has six positioning holes arranged in two rows, and respectively disposed for receiving the conducting plates, and a central groove communicated with four of the six positioning holes which are respectively located at four corners of the switch seat. The lower extending plate is disposed in the central groove, and is connected to one combination pair of the conducting plates which are respectively disposed at two diagonally opposite corners of the switch seat. The upper extending plate is disposed in the central groove and above the insulating member, and is connected to the other combination pair of the conducting plates which are respectively disposed at the other two diagonally opposite corners of the switch seat. The switch member includes two spaced-apart connecting plates. When the switch member is at the first position, each of the connecting plates abuts against two of the three conducting plates which are arranged in the same row, and which are close to a side of the switch seat, and when the switch member is at the second position, each of the connecting plates abuts against of the three conducting plates which are arranged in the same row, and which are close to an opposite side of the switch seat.

When the switch member is operated to move from the first position to the second position, the voltage direction is reversely changed so as to control the rotational direction of the motor of a ceiling fan.

However, when assembling the conventional switch, since it has a great number of components, an assembling operation is complicated and time-consuming. In addition, when the insulating member is carelessly omitted during assembly, the upper extending plate may come into contact with the lower extending plate and lead to a short circuit.

SUMMARY

Therefore, the object of the disclosure is to provide a switch that can alleviate at least one of the drawbacks of the prior art.

According to the disclosure, the switch includes a switch plate, a base seat, a top cap and a switch member. The switch plate includes a plate body, a pin unit mounted to the plate body, and a conducting unit connected to the pin unit. The pin unit includes a first pin, a second pin spaced apart from the first pin in a first direction, a third pin spaced apart from the first and second pins in the first direction, a fourth pin spaced apart from the first pin in a second direction which is perpendicular to the first direction, a fifth pin spaced apart from the fourth pin in the first direction and from the second pin in the second direction, a sixth pin spaced apart from the fourth and fifth pins in the first direction and from the third pin in the second direction, a first contact member mounted between first and second pins, and a second contact member mounted between the fourth and fifth pins. The first, second, third, fourth, fifth and sixth pins extend through the plate body of the switch plate in a third direction which is perpendicular to the first and second directions. The conducting unit includes a first conducting member mounted to a side of the plate body, and electrically connected between the first pin and the second contact member, a second conducting member mounted to an opposite side of the plate body, and electrically connected between the fourth pin and the first contact member, a third conducting member electrically connected between the second and third pins, and a fourth conducting member electrically connected between the fifth and sixth pins. The base seat has six mounting holes extending through the base seat in the third direction, and respectively disposed for the first, second, third, fourth, fifth and sixth pins to extend therethrough. The top cap is disposed on the base seat, and has a base wall, a surrounding wall extending from a periphery of the base wall toward the base seat in the third direction. The base wall, the surrounding wall and the base seat cooperatively define a receiving space disposed for receiving the plate body. The base wall has a through hole extending in the third direction through the base wall, and communicated with the receiving space. The switch member is movable relative to the top cap in the first direction, and has a moving portion disposed in the receiving space, an operating portion connected to a side of the moving portion, and extending outwardly from the through hole, and first and second resilient plates mounted to an opposite side of the moving portion. The first resilient plate has a first end portion abutting against the third conducting member, and a second end portion opposite to the first end portion, and abutting against one of the first pin and the first contact member. The second resilient plate has a third end portion abutting against the fourth conducting member, and a fourth end portion opposite to the third end portion, and abutting against one of the fourth pin and the second contact member.

BRIEF DESCRIPTION OF THE DRAWINGS

Other features and advantages of the disclosure will become apparent in the following detailed description of the embodiments with reference to the accompanying drawings, of which:

FIG. 5 is a bottom view of the first embodiment;

DETAILED DESCRIPTION

Figure 1:
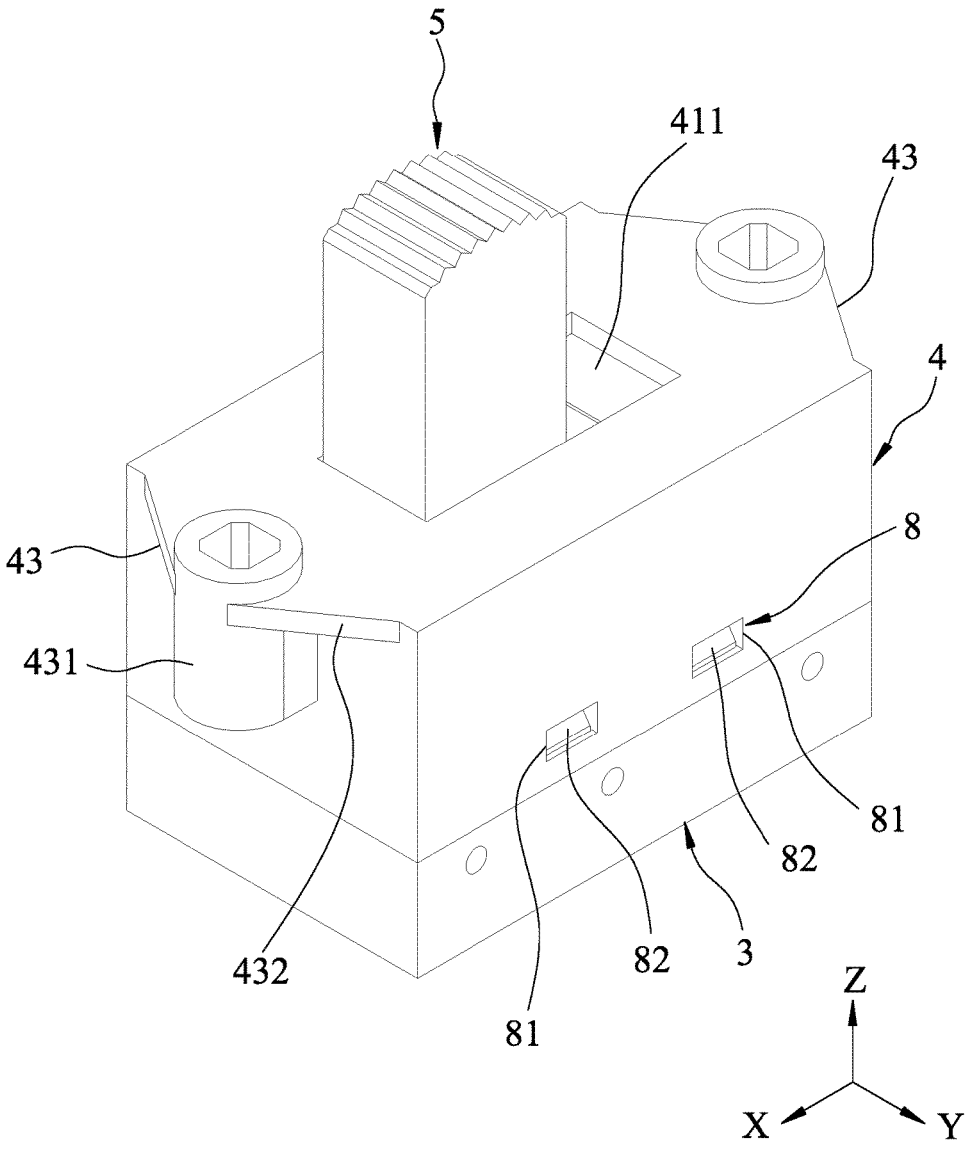
FIG. 1 is a perspective view illustrating a first embodiment of a switch for controlling rotational direction according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
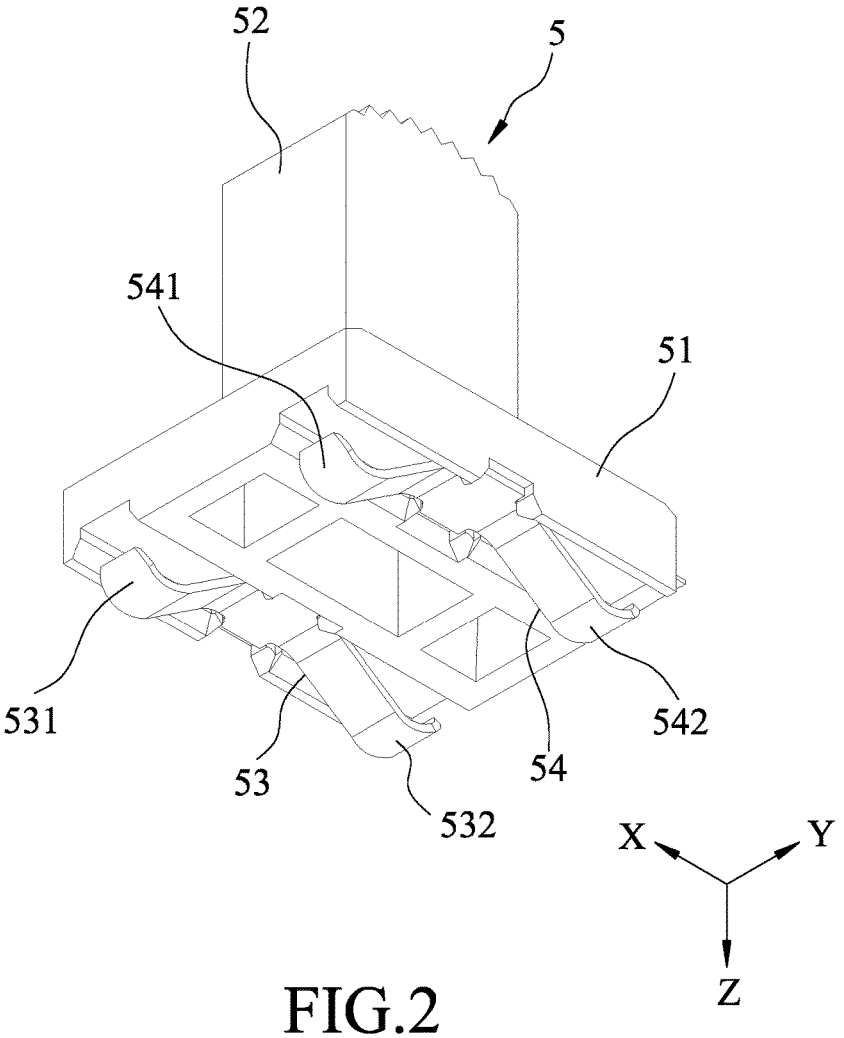
FIG. 2 is a perspective view of a switch member of the first embodiment.
Figure 3:
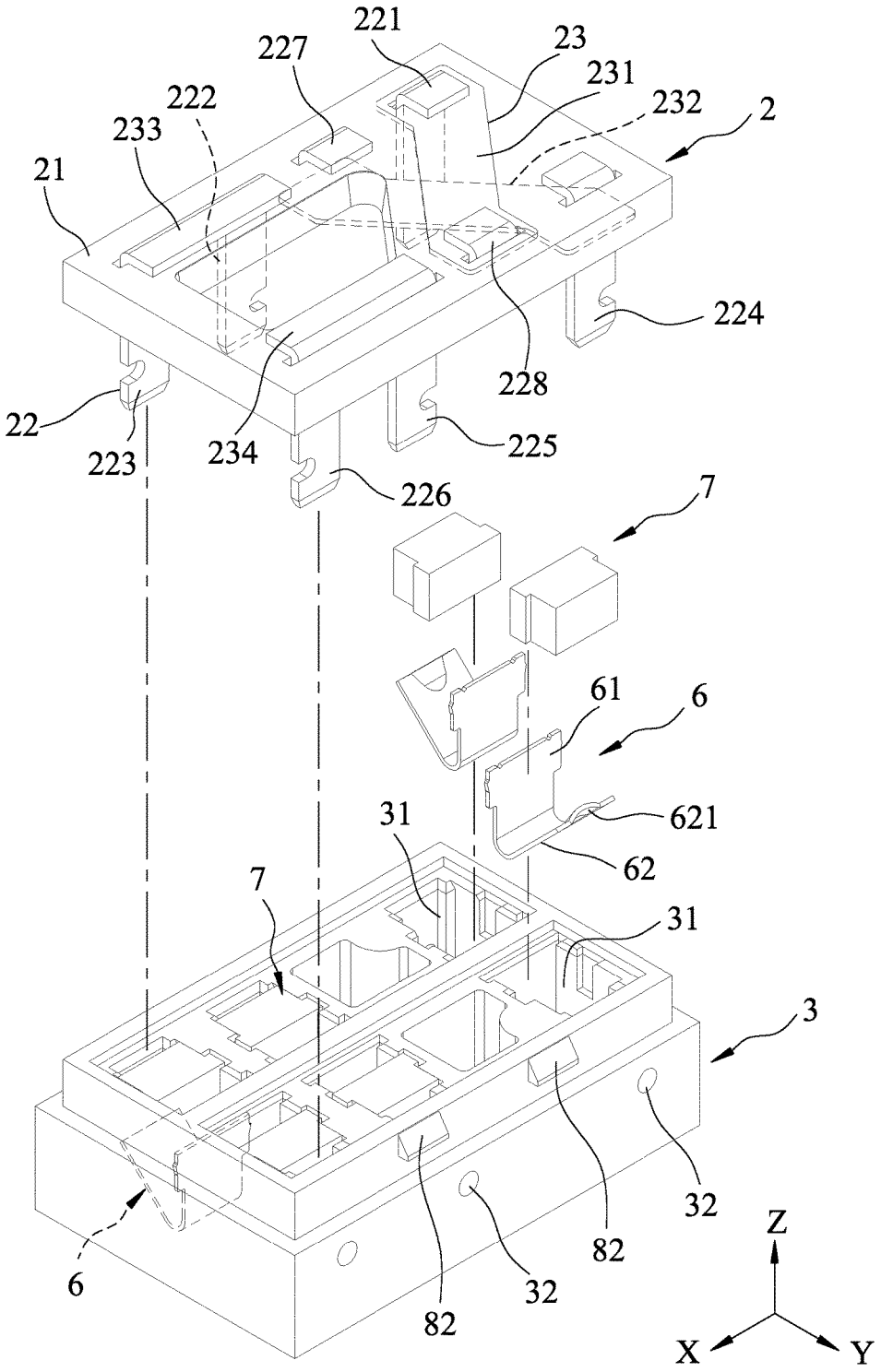
FIG. 3 is a fragmentary and partially exploded perspective view of the first embodiment.

Referring to FIGS. 1 to 3, the first embodiment of a switch according to the disclosure includes a switch plate 2, a base seat 3, a top cap 4, a switch member 5, six resilient holding members 6, six position limiting blocks 7 and a coupling unit 8.

Figure 4:
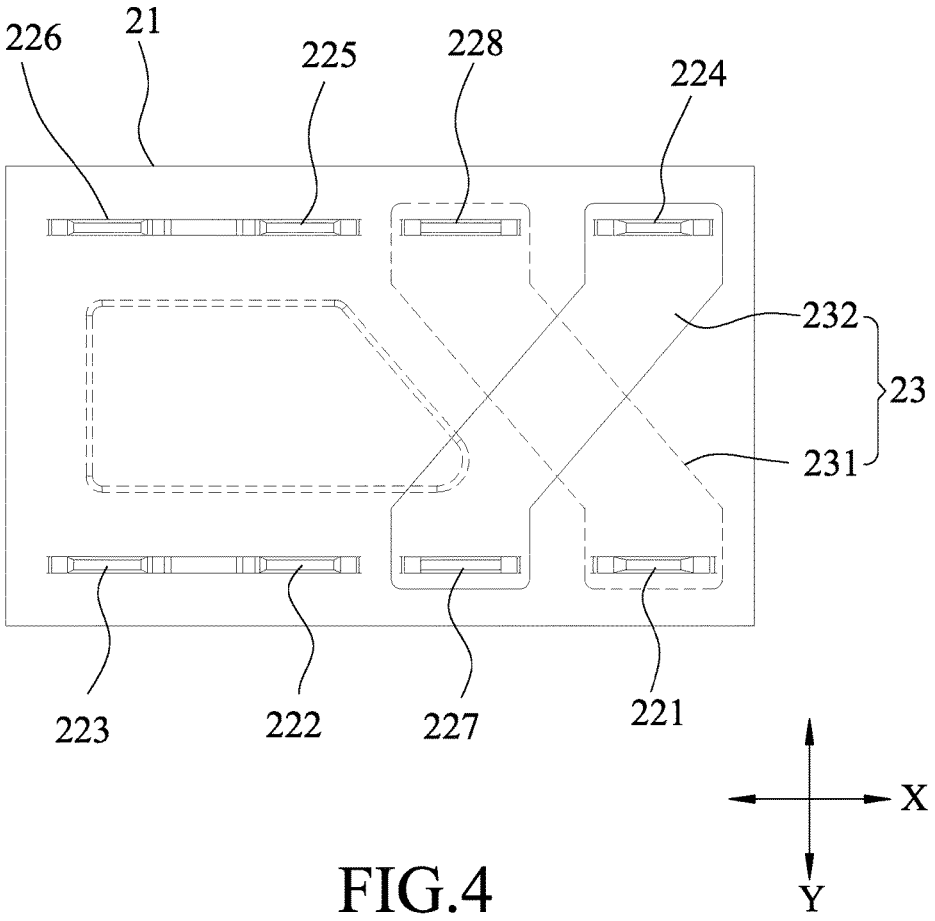
FIG. 4 is a bottom view of a switch plate of the first embodiment.

Referring to FIGS. 3 and 4, the switch plate 2 includes a plate body 21, a pin unit 22 mounted to the plate body 21, and a conducting unit 23 connected to the pin unit 22. It should be noted that, in this embodiment, the plate body 2 is made through an injection molding operation, and the method to produce the plate body 2 may be varied in other embodiments.

The pin unit 22 includes a first pin 221, a second pin 222 spaced apart from the first pin 221 in a first direction (X), a third pin 223 spaced apart from the first and second pins 221, 222 in the first direction (X), a fourth pin 224 spaced apart from the first pin 221 in a second direction (Y) which is perpendicular to the first direction (X), a fifth pin 225 spaced apart from the fourth pin 224 in the first direction (X) and from the second pin 222 in the second direction (Y), a sixth pin 226 spaced apart from the fourth and fifth pins 224, 225 in the first direction (X) and from the third pin 223 in the second direction (Y), a first contact member 227 mounted between the first and second pins 221, 222, and a second contact member 228 mounted between the fourth and fifth pins 224, 225. The first, second, third, fourth, fifth and sixth pins 221, 222, 223, 224, 225, 226, and the first and second contact members 227, 228 extend through the plate body 21 of the switch plate 2 in a third direction (Z) which is perpendicular to the first and second directions (X, Y).

The conducting unit 23 includes a first conducting member 231 mounted to a side (i.e. side surface) of the plate body 21, and electrically connected between the first pin 221 and the second contact member 228, a second conducting member 232 mounted to an opposite side (i.e. side surface) of the plate body 21, and electrically connected between the fourth pin 224 and the first contact member 227, a third conducting member 233 electrically connected between the second and third pins 222, 223, and a fourth conducting member 234 electrically connected between the fifth and sixth pins 225, 226. It should be noted that, in this embodiment, the third conducting member 233, the second and third pins 222, 223 are formed as one piece, the third conducting member 234, the fifth and six pins 225, 226 are formed as one piece, the first conducting member 231 is mounted to the side of the plate body 21 during the injection molding operation, the second conducting member 232 is mounted to the opposite side of the plate body 21 during the injection molding operation, and such configurations may be varied in other embodiments.

Figure 6:
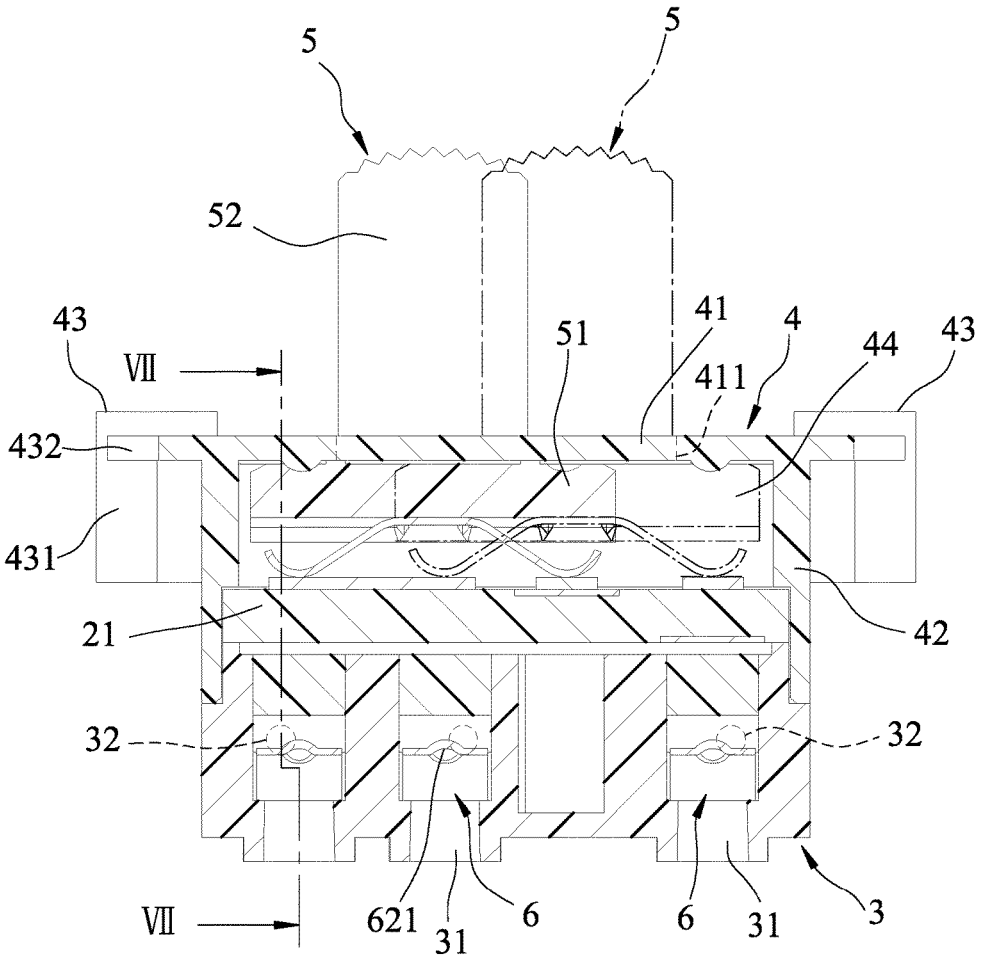
FIG. 6 is a sectional schematic view taken along line VI-VI in FIG. 5.
Figure 6:
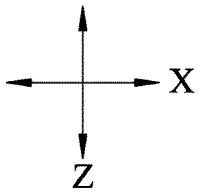

Referring to FIGS. 3, 5 and 6, the base seat 3 has six mounting holes 31 extending through the base seat 3 in the third direction (Z), and respectively disposed for the first, second, third, fourth, fifth and sixth pins 221, 222, 223, 224, 225, 226 to extend therethrough, and six side holes 32 respectively communicated with the mounting holes 31.

Figure 7:
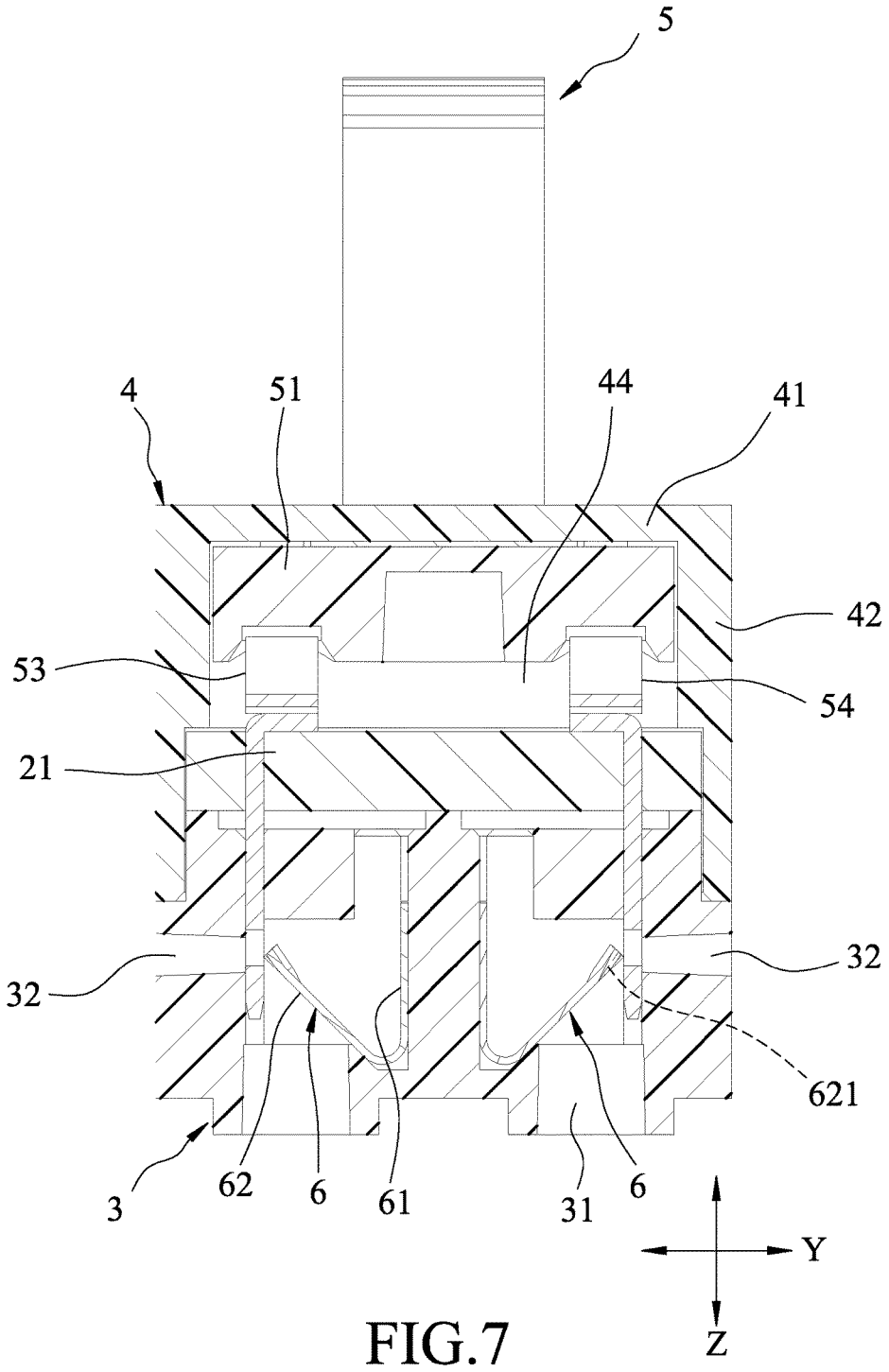
FIG. 7 is a sectional view taken along line VII-VII in FIG. 6.

Referring to FIGS. 1, 6 and 7, the top cap 4 is disposed on the base seat 3, and has a base wall 41, a surrounding wall 42 extending from a periphery of the base wall 41 toward the base seat 3 in the third direction (Z), and two side blocks 43 respectively extending from two opposite sides of the base wall 41 and the surrounding wall 42 away from each other in the first direction (X). The base wall 41, the surrounding wall 42 and the base seat 3 cooperatively define a receiving space 44 disposed for receiving the plate body 21. The base wall 41 has a through hole 411 extending in the third direction (Z) through the base wall 41, and communicated with the receiving space 44. Each of the side blocks 43 has a tube portion 431 extending in the third direction (Z), and a connecting portion 432 connected between the tube portion 431 and the base wall 41.

Two opposite end surfaces of each of the tube portions 431 of the side blocks 43 in the third direction (Z) (that is, the two opposite end surfaces are opposite to each other in the third direction (Z)) are not co-planar with a side surface of the base wall 41 that faces away from the base seat 3. The connecting portion 432 of each of the side blocks 43 is connected to an intermediate portion of the corresponding tube portion 431, and is shaped as a plate having a side surface that faces away from the base seat 3 and that is co-planar with the side surface of the base wall 41.

Referring to FIGS. 2, 6 and 7, the switch member 5 is movable relative to the top cap 4 in the first direction (X), and has a moving portion 51 disposed in the receiving space 44, an operating portion 52 connected to a side of the moving portion 51, and extending outwardly from the through hole 411 so as to allow for manual operation, and first and second resilient plates 53, 54 mounted to an opposite side of the moving portion 51.

Referring back to FIGS. 2, 3 and 7, the first resilient plate 53 has a first end portion 531 abutting against the third conducting member 233, and a second end portion 532 opposite to the first end portion 531, and abutting against a selected one of the first pin 221 and the first contact member 227. The second resilient plate 54 has a third end portion 541 abutting against the fourth conducting member 234, and a fourth end portion 542 opposite to the third end portion 541, and abutting against a selected one of the fourth pin 224 and the second contact member 228.

Referring back to FIGS. 2, 3 and 6, the switch member 5 is movable between a first position (as indicated with the imaginary lines of the switch member 5 in FIG. 6) and a second position (as indicated with the solid lines of the switch member 5 in FIG. 6).

When the switch member 5 is at the first position, the second end portion 532 of the first resilient plate 53 abuts against the first pin 221 and the fourth end portion 542 of the second resilient plate 54 abuts against the fourth pin 224 such that, the first pin 221, the second contact member 228, the first resilient plate 53, the third conducting member 233, the second pin 222 and the third pin 223 are electrically connected, and the fourth pin 224, the first contact member 227, the second resilient plate 54, the fourth conducting member 234, the fifth pin 225 and the six pin 226 are electrically connected.

When the switch member 5 is at the second position, the second end portion 532 of the first resilient plate 53 abuts against the first contact member 227 and the fourth end portion 542 of the second resilient plate 54 abuts against the second contact member 228 such that, the first contact member 227, the fourth pin 224, the first resilient plate 53, the third conducting member 233, the second pin 222 and the third pin 223 are electrically connected, and the second contact member 228, the first pin 221, the second resilient plate 54, the fourth conducting member 234, the fifth pin 225 and the six pin 226 are electrically connected.

Referring back to FIGS. 3, 6 and 7, the resilient holding members 6 are respectively disposed in the mounting holes 31 of the base seat 3. Each of the resilient holding members 6 is generally U-shaped, and has a first abutment end 61 abutting against the base seat 3, and a second abutment end 62 opposite to the first abutment end 61. The side holes 32 respectively correspond to the resilient holding members 6 in position. The second abutment end 62 of each of the resilient holding members 6 abuts against a respective one of the first, second, third, fourth, fifth and six pins 221, 222, 223, 224, 225, 226. The second abutment end 62 of each of the resilient holding members 6 has a concave part defining a slot 621 that has two opposite open ends.

The position limiting blocks 7 are respectively disposed in the mounting holes 31 of the base seat 3, for respectively 1 retaining the first, second, third, fourth, fifth and six pins 221, 222, 223, 224, 225, 226 in the mounting holes 31.

Referring back to FIGS. 1 and 3, the coupling unit 8 includes at least one coupling groove 81 formed in one of the base seat 3 and the top cap 4, and at least one coupling protrusion 82 formed on the other one of the base seat 3 and the top cap 4, and engaging the coupling groove 3 for fixing the top cap 4 to the base seat 3. It should be noted that, in this embodiment, the coupling unit 8 includes four coupling grooves 81 and four coupling protrusions 82, and the numbers of the coupling grooves 81 and the coupling protrusions 82 may be varied in other embodiments. In this embodiment, the coupling grooves 81 are formed in the top cap 4 and the coupling protrusions 82 are formed on the base seat 3, and such configurations may be varied in other embodiments.

Referring back to FIGS. 2, 3 and 6, when assembling the switch, a first electric wire (not shown), a second electric wire (not shown), a third electric wire (not shown) and a fourth electric wire (not shown) are inserted into corresponding mounting holes 31 from a side of the base seat 3 which is opposite to the top cap 4.

In such a manner, connection relationships are as follows: the first electric wire is clamped between the first pin 221 and the corresponding one of the resilient holding members 6 such that, it is electrically connected to the first pin 221 and extends into the corresponding slot 621; the second electric wire is clamped between one of the second and third pins 222, 223 and the corresponding one of the resilient holding members 6 such that it is electrically connected to the second and third pins 222, 223 and extends into the corresponding slot 62; the third electric wire is clamped between the fourth pin 224 and the corresponding one of the resilient holding members 6 such that it is electrically to the fourth pin 224 and extends into the corresponding slot 62; and the fourth electric wire is clamped between one of the fifth and sixth pins 225, 226 and the corresponding one of the resilient holding members 6 such that it is electrically connected to the fifth and sixth pins 225, 226 and extends into the corresponding slot 62.

The first and third electric wires are respectively and electrically connected to two input terminals such that, when the switch member 5 is moved to the first position, the second electric wire is electrically connected to the first electric wire, and the fourth electric wire is electrically connected to the third electric wire. As a result, the voltage direction of the currents flowing in the second electric wire and the fourth electric wires is the same as that of the input voltage. When the switch member 5 is moved to the second position, the second electric wire is electrically connected to the third electric wire, and the fourth electric wire is electrically connected to the first electric wire. As a result, the voltage direction of the currents flowing in the second and the fourth electric wires is opposite to that of the input voltage. Therefore, the voltage direction of the motor can be conveniently switched by changing the position of the switch member 5.

Referring back to FIGS. 2, 3 and 7, with the disposition of the slots 621 of the resilient holding members 6, the first, second, third and fourth electric wires can be conveniently mounted, and contact areas between the first, second, third and fourth electric wires and the resilient holding members 6 can be increased, so as to increase the steadiness of the electric connections.

When any one of the first, second, third and fourth electric wires is required to be removed, a user is required to insert a needle into a corresponding one of the side holes 32 and push the second abutment portion 62 of the corresponding one of the resilient holding members 6. As a result, the one of the first, second, third and fourth electric wires can be released and removed.

In addition, since the first and second conducting members 231, 232 are respectively mounted to two sides of the plate body 21 during the injection molding operation, the assembling cost is decreased, and the danger of short circuit can be prevented.

Figure 8:
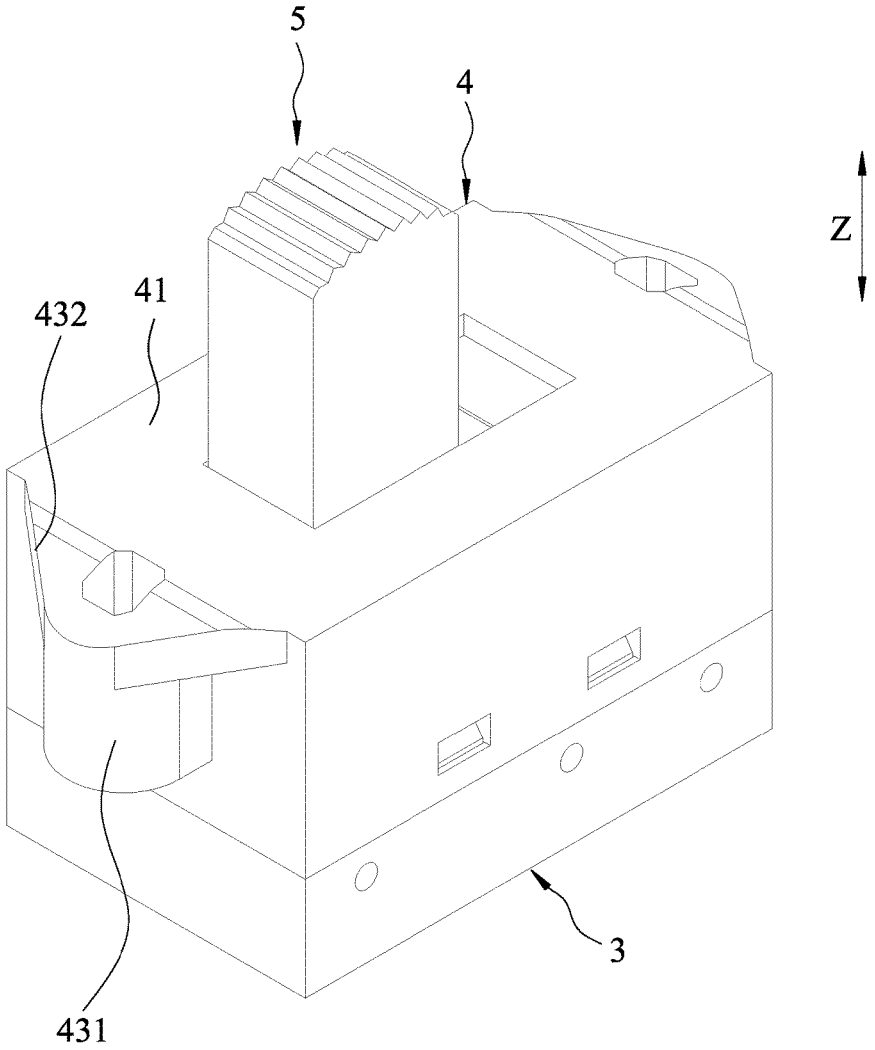
FIG. 8 is a perspective view illustrating a second embodiment of the switch according to the disclosure.
Figure 9:
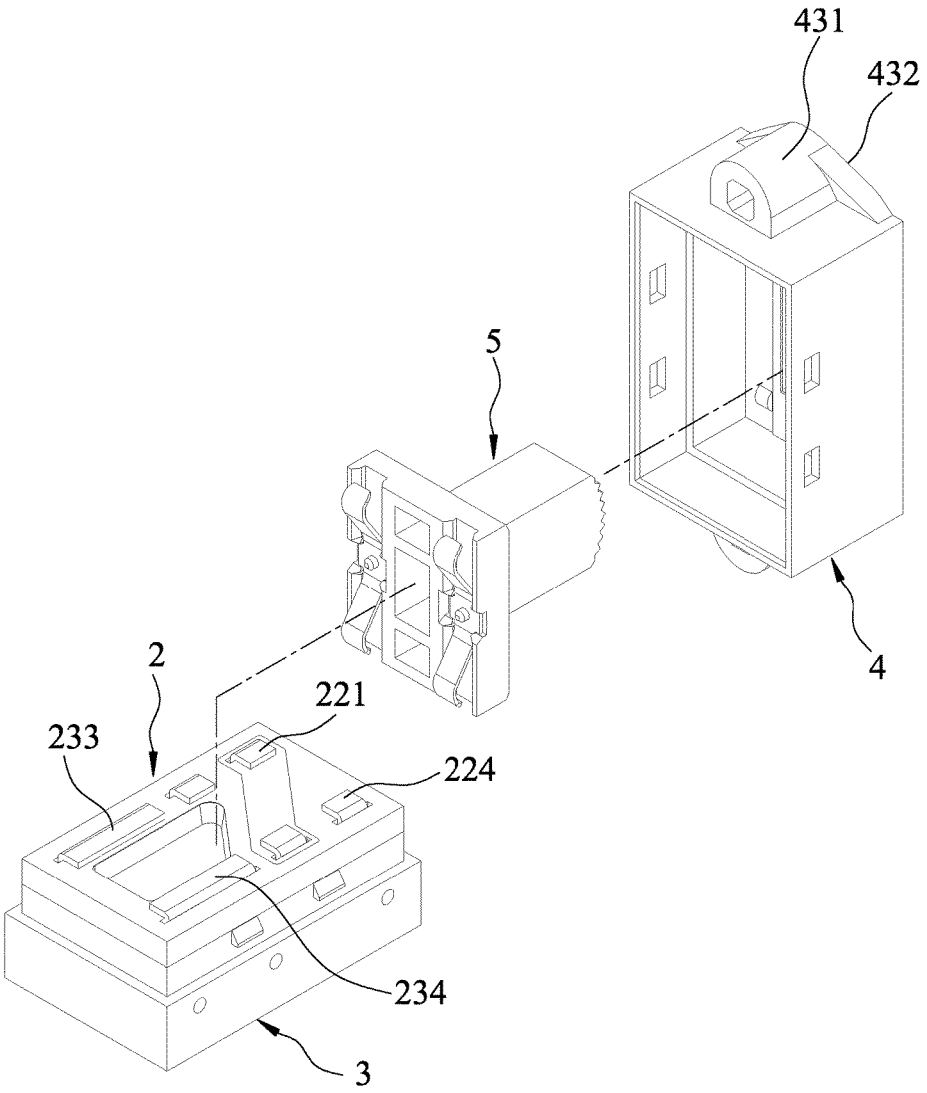
FIG. 9 is a partially exploded perspective view of the second embodiment.

Referring to FIGS. 8 and 9, the second embodiment has a structure similar to that of the first embodiment. The main difference between this embodiment and the previous embodiment resides in the configuration of the top cap 4. In this embodiment, the connecting portion 432 of each of the side blocks 43 is shaped as a plate having two opposite side surfaces. One of the side surfaces of the connecting portion 432 of each of the side blocks 43 that faces away from the base seat 3 extends obliquely and outwardly from a side surface of the base wall 41 toward a side where the base seat 3 is located. The second embodiment has the same advantages as those of the first embodiment.

In conclusion, with the disposition of the switch plate 2 and the switch member 5, the voltage direction of the motor can be conveniently switched.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A switch comprising:

a switch plate including a plate body, a pin unit that is mounted to said plate body, and a conducting unit that is connected to said pin unit, said pin unit including a first pin, a second pin that is spaced apart from said first pin in a first direction, a third pin that is spaced apart from said first and second pins in the first direction, a fourth pin that is spaced apart from said first pin in a second direction which is perpendicular to the first direction, a fifth pin that is spaced apart from said fourth pin in the first direction and from said second pin in the second direction, a sixth pin that is spaced apart from said fourth and fifth pins in the first direction and from said third pin in the second direction, a first contact member that is mounted between said first and second pins, and a second contact member that is mounted between said fourth and fifth pins, said first, second, third, fourth, fifth and sixth pins extending through said plate body of said switch plate in a third direction which is perpendicular to the first and second directions, said conducting unit including a first conducting member that is mounted to a side of said plate body, and that is electrically connected between said first pin and said second contact member, a second conducting member that is mounted to an opposite side of said plate body, and that is electrically connected between said fourth pin and said first contact member, a third conducting member that is electrically connected between said second and third pins, and a fourth conducting member that is electrically connected between said fifth and sixth pins;

a base seat having six mounting holes that extend through said base seat in the third direction, and that are respectively disposed for said first, second, third, fourth, fifth and sixth pins to extend therethrough;

a top cap disposed on said base seat, and having a base wall, a surrounding wall that extends from a periphery of said base wall toward said base seat in the third direction, said base wall, said surrounding wall and said base seat cooperatively defining a receiving space that is disposed for receiving said plate body, said base wall having a through hole that extends in the third direction through said base wall, and that is communicated with said receiving space; and a switch member movable relative to said top cap in the first direction, and having a moving portion that is disposed in said receiving space, an operating portion that is connected to a side of said moving portion, and that extends outwardly from said through hole, and first and second resilient plates that are mounted to an opposite side of said moving portion, said first resilient plate having a first end portion that abuts against said third conducting member, and a second end portion that is opposite to said first end portion, and that abuts against a selected one of said first pin and said first contact member, said second resilient plate having a third end portion that abuts against said fourth conducting member, and a fourth end portion that is opposite to said third end portion, and that abuts against a selected one of said fourth pin and said second contact member.

2. The switch as claimed in claim 1, further comprising six resilient holding members respectively disposed in said mounting holes of said base seat, each of said resilient holding members having a first abutment end that abuts against said base seat, and a second abutment end that is opposite to said first abutment end, said second abutment end of each of said resilient holding members abutting against a respective one of said first, second, third, fourth, fifth and six pins.

3. The switch as claimed in claim 2, wherein said base seat further has six side holes respectively communicated with said mounting holes, and respectively corresponding to said resilient holding members in position.

4. The switch as claimed in claim 2, wherein said second abutment end of each of said resilient holding members has a concave part defining a slot that has two opposite open ends.

5. The switch as claimed in claim 2, further comprising six position limiting blocks respectively disposed in said mounting holes of said base seat, and respectively retaining said first, second, third, fourth, fifth and six pins in said mounting holes.

6. The switch as claimed in claim 1, further comprising a coupling unit including at least one coupling groove formed in one of said base seat and said top cap, and at least one coupling protrusion formed on the other one of said base seat and said top cap, and engaging said coupling groove for fixing said top cap to said base seat.

7. The switch as claimed in claim 1 wherein:

said top cap further has two side blocks respectively extending from two opposite sides of said base wall and said surrounding wall away from each other; and each of said side blocks has a tube portion extending in the third direction, and a connecting portion connected between said tube portion and said base wall.

8. The switch as claimed in claim 7, wherein:

two opposite end surfaces of each of said tube portions of said side blocks in the third direction are not co-planar with a side surface of said base wall that faces away from said base seat; and said connecting portion of each of said side blocks is connected to an intermediate portion of a corresponding one of said tube portions, and is shaped as a plate having a side surface that faces away from said base seat and that is co-planar with said side surface of said base wall.

9. The switch as claimed in claim 7, wherein:

said connecting portion of each of said side blocks is shaped as a plate having two opposite side surfaces; and one of said side surfaces of said connecting portion of each of said side blocks that faces away from said base seat extends obliquely and outwardly from a side surface of said base wall toward a side where said base seat is located.

* * * * *